US007261278B2

(12) United States Patent
Ball et al.

(10) Patent No.: US 7,261,278 B2
(45) Date of Patent: Aug. 28, 2007

(54) POWERED ROPE ASCENDER AND PORTABLE ROPE PULLING DEVICE

(75) Inventors: Nathan Ball, Cambridge, MA (US); Timothy Fofonoff, Cambridge, MA (US); Bryan Schmid, Boston, MA (US); Daniel Walker, Cambridge, MA (US)

(73) Assignee: Atlas Devices, LLC, Cambridge, MA (US)

( * ) Notice: Subject to any disclaimer, the term of this patent is extended or adjusted under 35 U.S.C. 154(b) by 0 days.

(21) Appl. No.: 11/376,721

(22) Filed: Mar. 15, 2006

(65) Prior Publication Data

US 2006/0273293 A1 Dec. 7, 2006

Related U.S. Application Data

(60) Provisional application No. 60/673,212, filed on Apr. 20, 2005, provisional application No. 60/717,343, filed on Sep. 15, 2005.

(51) Int. Cl.
*B66D 1/36* (2006.01)

(52) U.S. Cl. ..... 254/325; 254/371

(58) Field of Classification Search ..... 254/278, 254/282, 323, 325, 326, 333, 342, 371; 182/133, 182/142

See application file for complete search history.

(56) References Cited

U.S. PATENT DOCUMENTS 3,048,370 A 8/1962 Kratzer
3,645,503 A * 2/1972 Doerfling ..... 242/157.1
3,707,275 A 12/1972 Arnold
3,843,094 A * 10/1974 Watts ..... 254/333
3,915,432 A 10/1975 Bustamante
3,968,953 A 7/1976 Guangorena
4,448,393 A 5/1984 Habegger et al.
4,927,537 A * 5/1990 Meurer ..... 210/527
6,109,633 A 8/2000 Schweizer
6,371,449 B1 * 4/2002 Chamberlain ..... 254/387
6,394,420 B2 * 5/2002 Kiviniitty ..... 254/333
6,488,267 B1 12/2002 Goldberg et al.
6,523,806 B2 * 2/2003 Bartal ..... 254/323
6,782,973 B1 8/2004 Schmidt et al.
7,028,989 B2 * 4/2006 Flynn et al. ..... 254/323

FOREIGN PATENT DOCUMENTS

EP 1 577 254 9/2005

OTHER PUBLICATIONS

International Search Report, from corresponding PCT/US2006/014830, dated Aug. 11, 2006.

* cited by examiner

*Primary Examiner*—Emmanuel M Marcelo
(74) *Attorney, Agent, or Firm*—Nutter, McClennen & Fish, LLP

(57) ABSTRACT

A device for pulling an elongate member includes a powered rotational motor having an output and a rotating drum connected to the output of said rotational motor where the rotating drum has a longitudinal axis and a circumference. The device further includes a guide mechanism for guiding the resilient elongate element onto, around at least a portion of the circumference of, and off of, the rotating drum. When the powered rotational motor turns the rotating drum, the rotating drum thereby continuously pulls the resilient elongate element through the device.

41 Claims, 11 Drawing Sheets

POWERED ROPE ASCENDER AND PORTABLE ROPE PULLING DEVICE

RELATED APPLICATIONS

This application claims priority to U.S. Provisional Application No. 60/673,212, filed Apr. 20, 2005, entitled "Powered Rope Ascender and Portable Rope Pulling Device," and U.S. Provisional Application No. 60/717,343, filed Sep. 15, 2005, entitled "Powered Rope Ascender and Portable Rope Pulling Device," both of which are incorporated by reference herein.

FIELD OF INVENTION

This invention relates to devices for moving an object by pulling on an elongate element to which the object is attached. More particularly, the invention relates to a device that can lift or pull heavy objects by pulling on a rope or cable.

BACKGROUND OF THE INVENTION

Winches are typically used to lift heavy loads or pull loads across horizontal obstacles. Winches are either motor-driven or hand powered and utilize a drum around which a wire rope (i.e. metal cable) or chain is wound. Manually lifting or pulling heavy objects is not a viable option due to the strength required to lift or pull such objects. Often, fatigue and injury result from manually lifting or pulling such objects. This is why winches are used; they possess massive pulling and towing capabilities, and can serve well for handling heavy objects.

However, winches are limited in their usefulness for several reasons. First, the cable or rope is fixed permanently to the drum, which limits the maximum pull distance and restricts the towing medium to only that rope or cable. Second, the winch must be fixed to a solid structure to be used, limiting its placement and usability. Third, controlled release of tension is not a capability of many winches, further limiting usability.

Current technology in rope ascenders used by people for vertical climbing consists of passive rope ascenders which must be used in pairs. These rope ascenders function as a one-way rope clamp, to be used in pairs. By alternating which ascender bears the load and which ascender advances, upward motion along a rope can be created.

Passive ascenders such as these are severely limited in their usefulness for several reasons. First, they rely on the strength of the user for upward mobility. Thus, passive ascenders are not useful in rescue situations where an injured person needs to move up a rope. Second, the need to grip one ascender with each hand limits multi-tasking during an ascent because both hands are in use. Third, the rate and extent of an ascent are limited to the capabilities of the user. Fourth, the diamond grit used to grip the rope is often too abrasive, destroying climbing ropes for future use. Fifth, the type of rope to be used is limited by what the ascenders' one-way locks can interact properly with.

Raising heavy loads upward via cable is accomplished by winches pulling from above the load, or by a device such as a hydraulic lift that pushes from below. Passive rope ascenders are useless for moving a dead weight load upward along a rope. U.S. Pat. No. 6,488,267 to Goldberg et al., entitled "Apparatus for Lifting or Pulling a Load" is an apparatus which uses two passive ascenders along a rope with a pneumatic piston replacing the power a human would normally provide. Thus, this powered device is limited in its usefulness by the same factors mentioned above. In addition, the lifting capacity and rate of ascent are is limited by the power source that fuels the pneumatic piston.

A further drawback of this design is that at any reasonable rate the load will experience a significant jerking motion in the upward direction during an ascent. Therefore, fragile loads will be at risk if this device is used.

It is therefore an object of the present invention to provide an apparatus for lifting or pulling heavy loads which solves one or more of the problems associated with the conventional methods and techniques described above.

It is another object of the present invention to provide an apparatus for lifting or pulling heavy loads which can be manufactured at reasonable costs.

It would also be desirable as well to be able to attach any such rope pulling device to a rope at any point along that rope without having to thread an end of the rope or cable through the device. This would increase the usability of such a device considerably over other rope pulling and climbing devices, allowing for instance a user to attach himself for ascent at a second story window past which a rope hangs.

Other objects and advantages of the present invention will be apparent to one of ordinary skill in the art in light of the ensuing description of the present invention. One or more of these objectives may include:

(a) to provide a line pulling device that can handle a range of rope types, cables, and diameters;
(b) to provide a device which does not require an end of the rope or cable to be fixed to the device;
(c) to provide a device which provides a smooth, controlled, continuous pull;
(d) to provide a device which itself is capable of traveling upward along a rope or cable smoothly and continuously to raise a load or a person;
(e) to provide a device which is easy and intuitive to use by minimally trained or untrained personnel;
(f) to provide a device which can let out or descend a taut rope or cable at a controlled rate with a range of loads;
(g) to provide a device which can apply its pulling force both at high force levels, for portable winching applications, and at fast rates, for rapid vertical ascents;
(h) to provide a device with a safety lock mechanism that prevents unwanted reverse motion of the rope or cable;
(i) to provide a device that can attach to a rope or cable at any point without having to thread an end of the rope or cable through the device;
(j) to provide a device that is not limited in its source of power to any particular type of rotational motor; and
(k) to provide a device that is usable in and useful for recreation, industry, emergency, rescue, manufacturing, military, and any other application relating to or utilizing rope, cable, string, or fiber tension.

Still further objects and advantages are to provide a rope or cable pulling device that is as easy to use as a cordless power drill, that can be used in any orientation, that can be easily clipped to either a climbing harness or Swiss seat, that can be just as easily attached to a grounded object to act as a winch, that is powered by a portable rotational motor, and that is lightweight easy to manufacture.

SUMMARY OF THE INVENTION

The invention provides a rope or cable pulling device that preferably accomplishes one or more of the objects of the invention or solves at least one of the problems described above.

In a first aspect, a device of the invention includes a powered rotational motor having an output and a rotating drum connected to the output of said rotational motor where the rotating drum has a longitudinal axis and a circumference. The device further includes a guide mechanism for guiding the resilient elongate element onto, around at least a portion of the circumference of, and off of the rotating drum. When the powered rotational motor turns the rotating drum, the rotating drum thereby continuously pulls the resilient elongate element through the device.

A device of the invention can conveniently be configured as a portable hand-held device, and in particular, can be configured as a portable rope ascender. Further aspects of the invention will become clear from the detailed description below, and in particular, from the attached claims.

DETAILED DESCRIPTION

Figure 1:
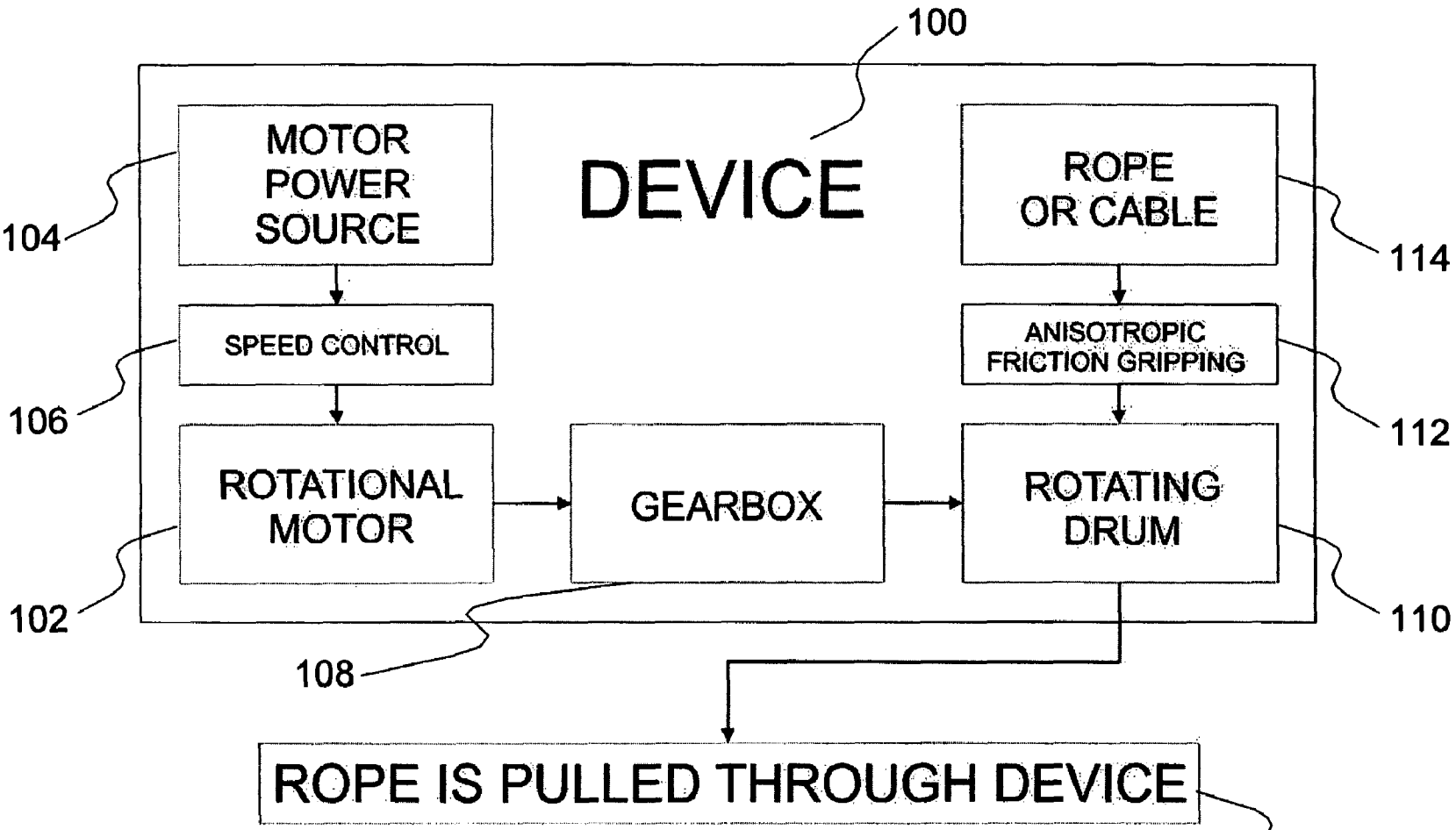
FIG. 1 provides a diagrammatic view of a device of the invention.

Referring now to FIG. 1, a device 100 of the invention for pulling a resilient elongate element such as a cable or a rope 114 is illustrated diagrammatically. The device includes a rotational motor 102 from which the pulling motion of the device is derived. A number of different types of motors, such as two or four stroke internal combustion engines, or ac or dc powered electric motors, could be employed to provide the rotational motion desired for pulling the rope or cable. A motor power source 104 can also be included that is appropriate to the rotational motor used, such as gasoline or other petroleum products, a fuel cell, or electrical energy supplied in ac (such as from a power outlet in a typical building) or dc (such as from a battery) form. In one preferred embodiment, the rotational motor is a dc electric motor and the motor power source is one or more rechargeable lithium ion batteries.

The rotational motor can also have speed control 106 and/or a gearbox 108 associated with it to control the speed and torque applied by the rotational motor to the task of pulling a rope. These elements can be integrated into a single, controllable, motor module, be provided as separate modules, or be provided in some combination thereof. In one embodiment, speed control elements can be provided integrally with a dc rotational motor, while a separate, modular gearbox is provided so that the gearing, and thus the speed and torque characteristics of the rope pulling device, can be altered as desired by swapping the gears.

A rotating drum 110 is connected to the rotational motor, either directly or through a gearbox (if one is present). It is the rotating drum, generally in the manner of a capstan, that applies the pulling force to the rope that is pulled through the device 116. In a preferred embodiment of the invention, the rotating drum provides anisotropic friction gripping 112 of the rope. In particular, in a preferred embodiment, the surface of the rotating drum has been treated so that large friction forces are created in the general direction of the pulling of the rope (substantially around the circumference of the drum), and smaller friction forces are created longitudinally along the drum so that the rope can slide along the length of the drum with relative ease.

Figure 9:
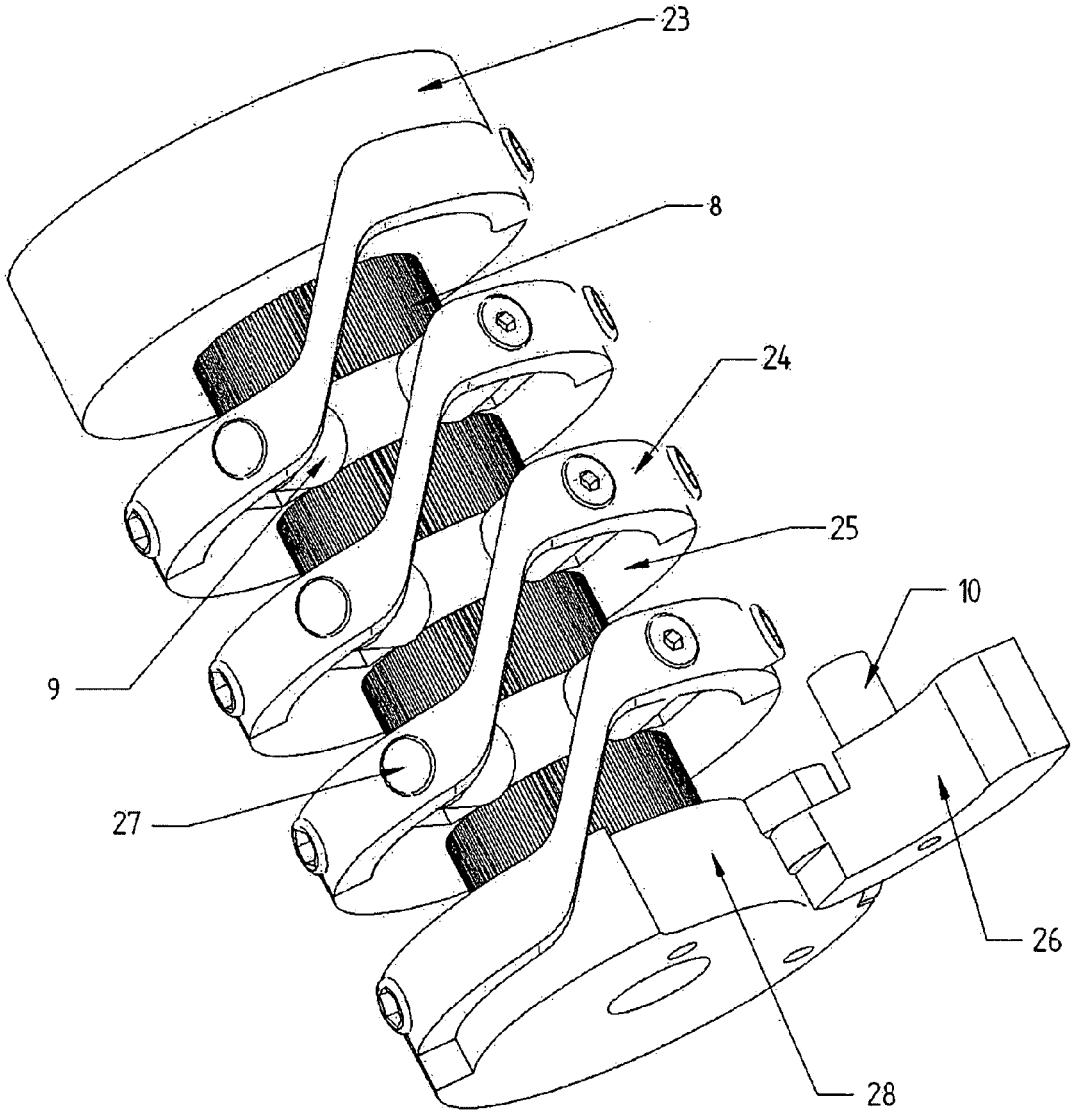
FIG. 9 illustrates a further embodiment of the invention.
Figure 10:
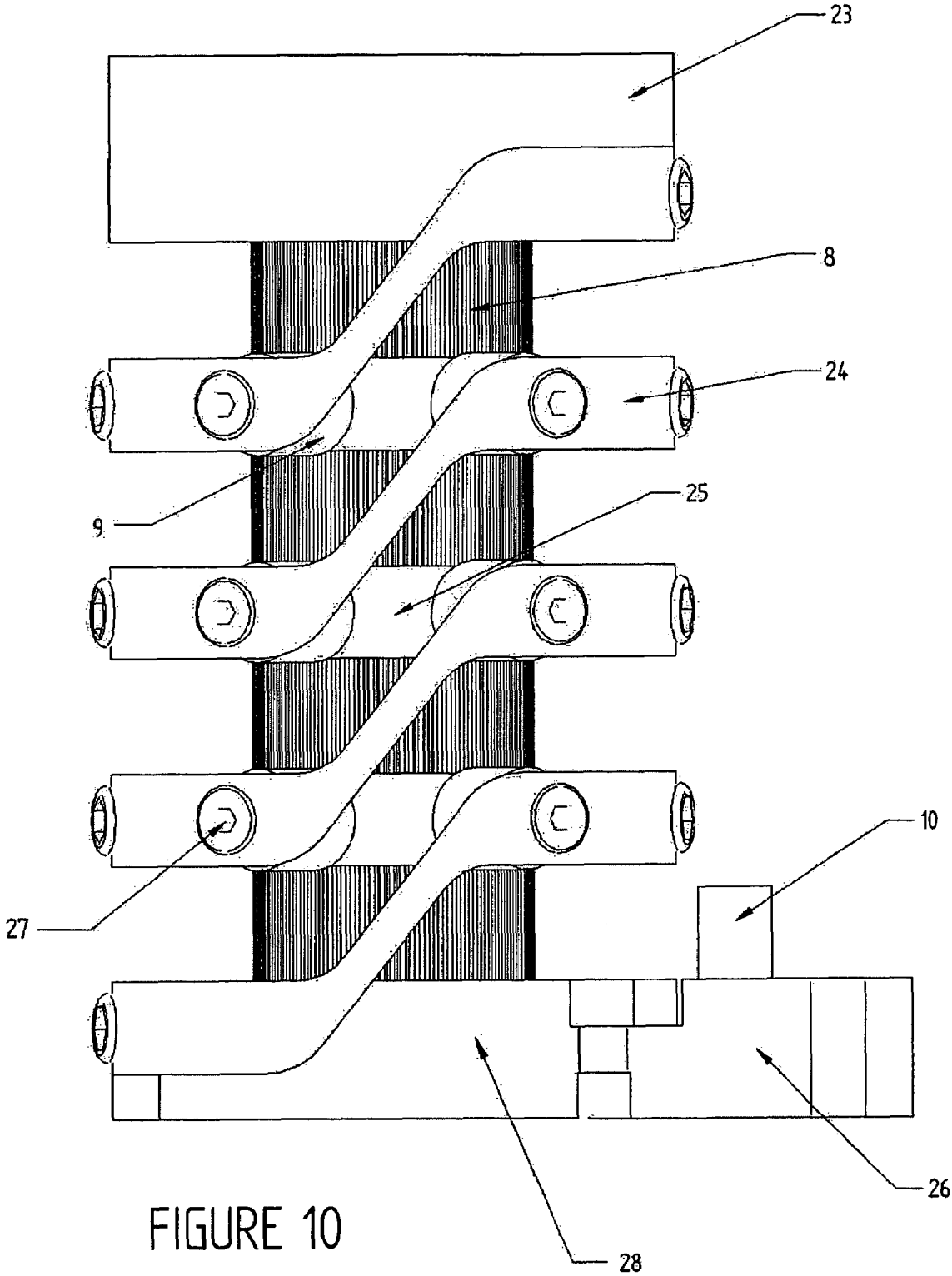
FIG. 10 shows isometric view of the embodiment of FIG. 9.
Figure 11:
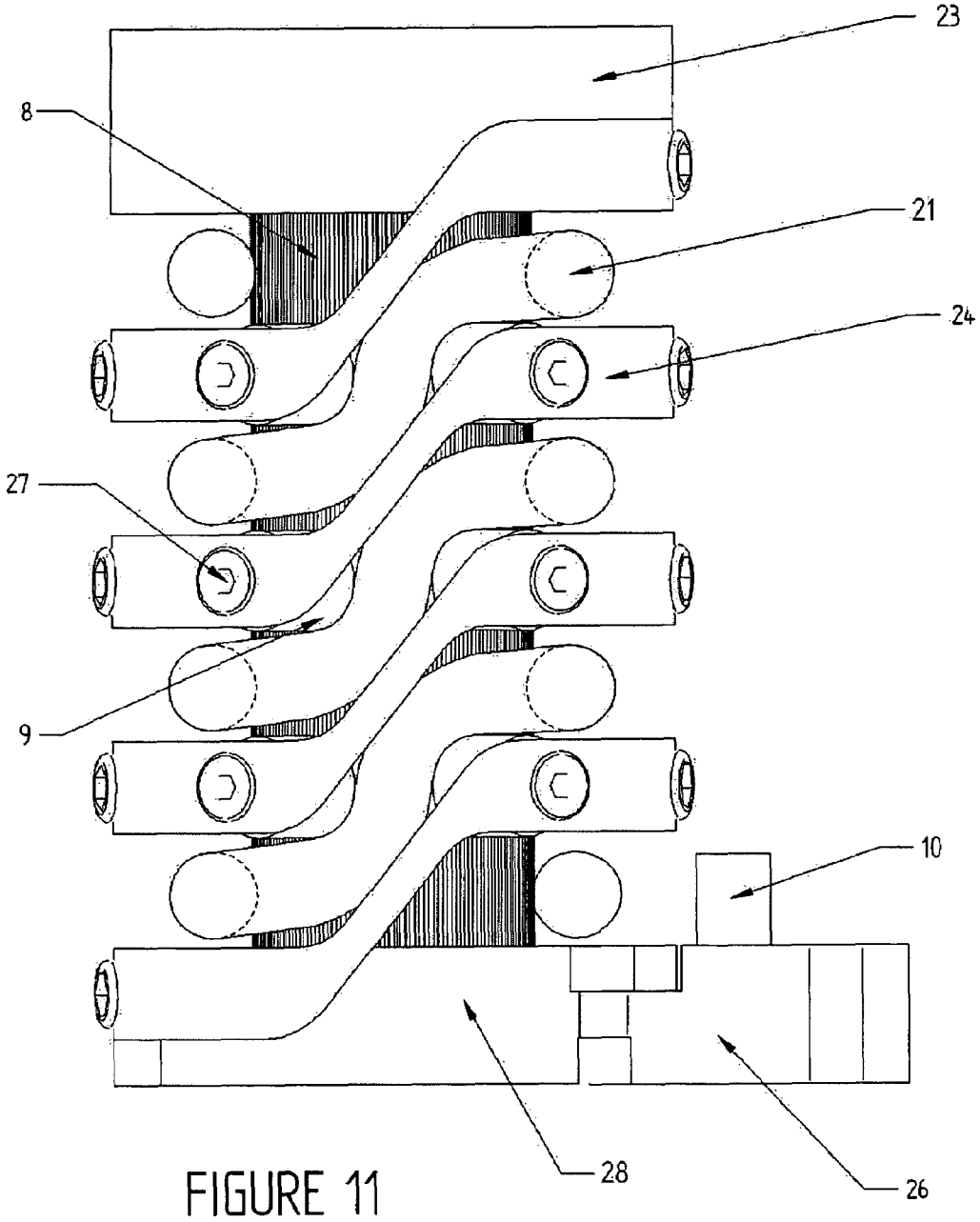
FIG. 11 shows a side view of the embodiment of FIG. 9.

In the alternative embodiment of the rope interaction assembly depicted in FIGS. 9, 10 and 11, the rotating drum is split into sections. These sections rotate between stationary sections which contain guide rollers that move the rope from one wrap to the next. This embodiment also makes use of the splined drum to exploit the anisotropic friction when advancing the rope from each wrap to the next.

A rope or cable is also referenced in FIG. 1. The device of the present invention is intended to be able to be able to pull any elongate resilient element that can withstand a tension. Cables and ropes are the most common of these, but the invention is not meant to be limited by the reference to ropes or cables.

Figure 2:
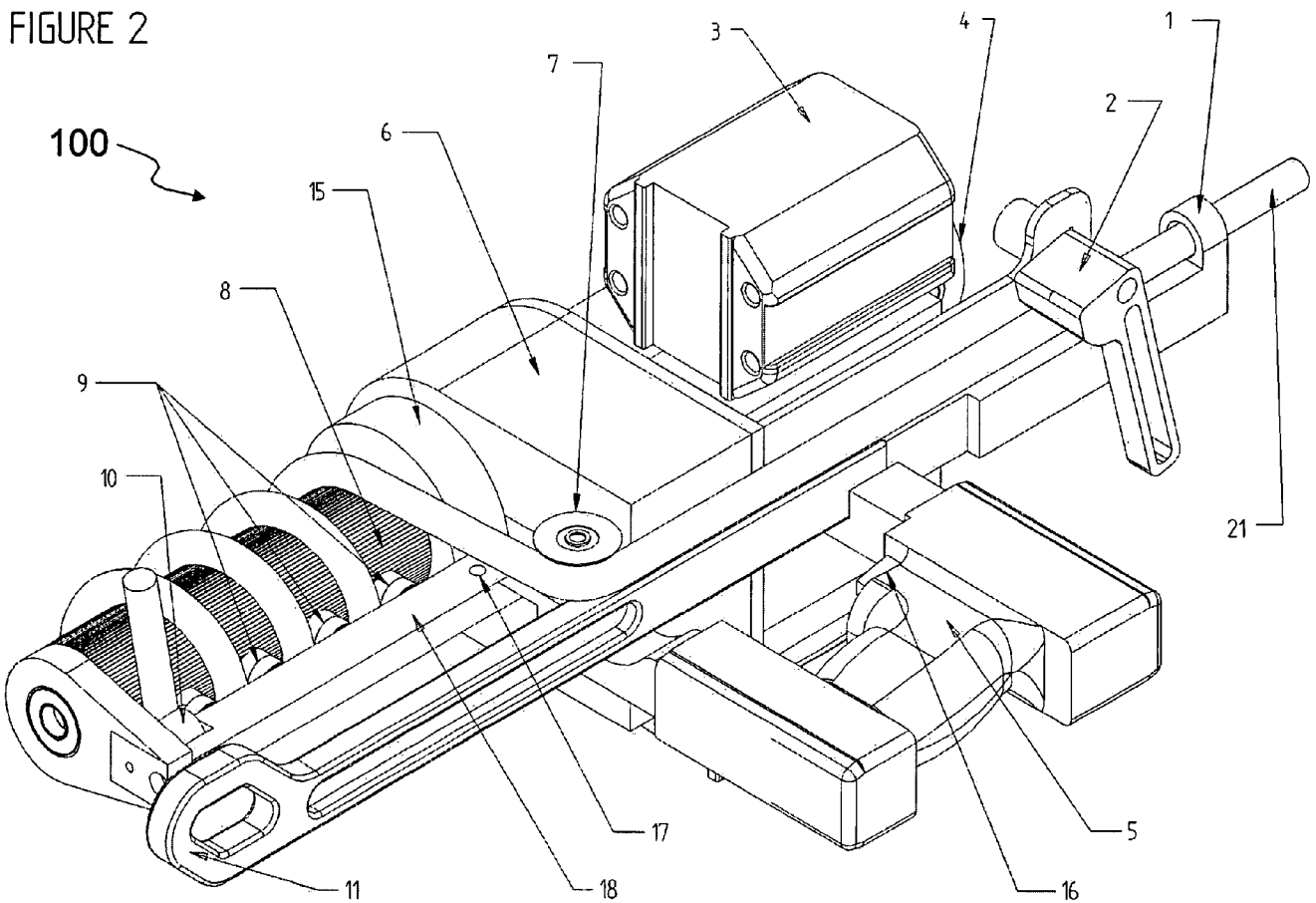
FIG. 2 shows an isometric view of an embodiment of the invention, showing a motor, batteries, handle, rotating drum, guiding rollers, safety clamp, tensioning roller and clip-in attachment point.

A preferred embodiment of a rope pulling device 100 of the invention is shown in FIGS. 2 (Isometric view), 3 (front view) and 4 (side view). In this embodiment, rotational motor 4 applies rotational power to rotating drum 8 via gearbox 6. Batteries 3 apply necessary power to motor 4. A rope handling mechanism guides a rope to and from the rotating drum. In particular, rope 21 enters through rope guide 1 and continues through safety clamp 2. The rope is further guided tangentially onto the rotating drum 8 by a pulley 7 and rotating guide 15. Once the rope is on the drum 8 it is guided around the drum 8 by the rollers 9 (and non-labeled adjacent rollers). On the last turn, the rope passes between the tensioning roller 10 and the drum 8. A user attaches to the device, such as by a tether, at attachment point 11.

Figure 3:
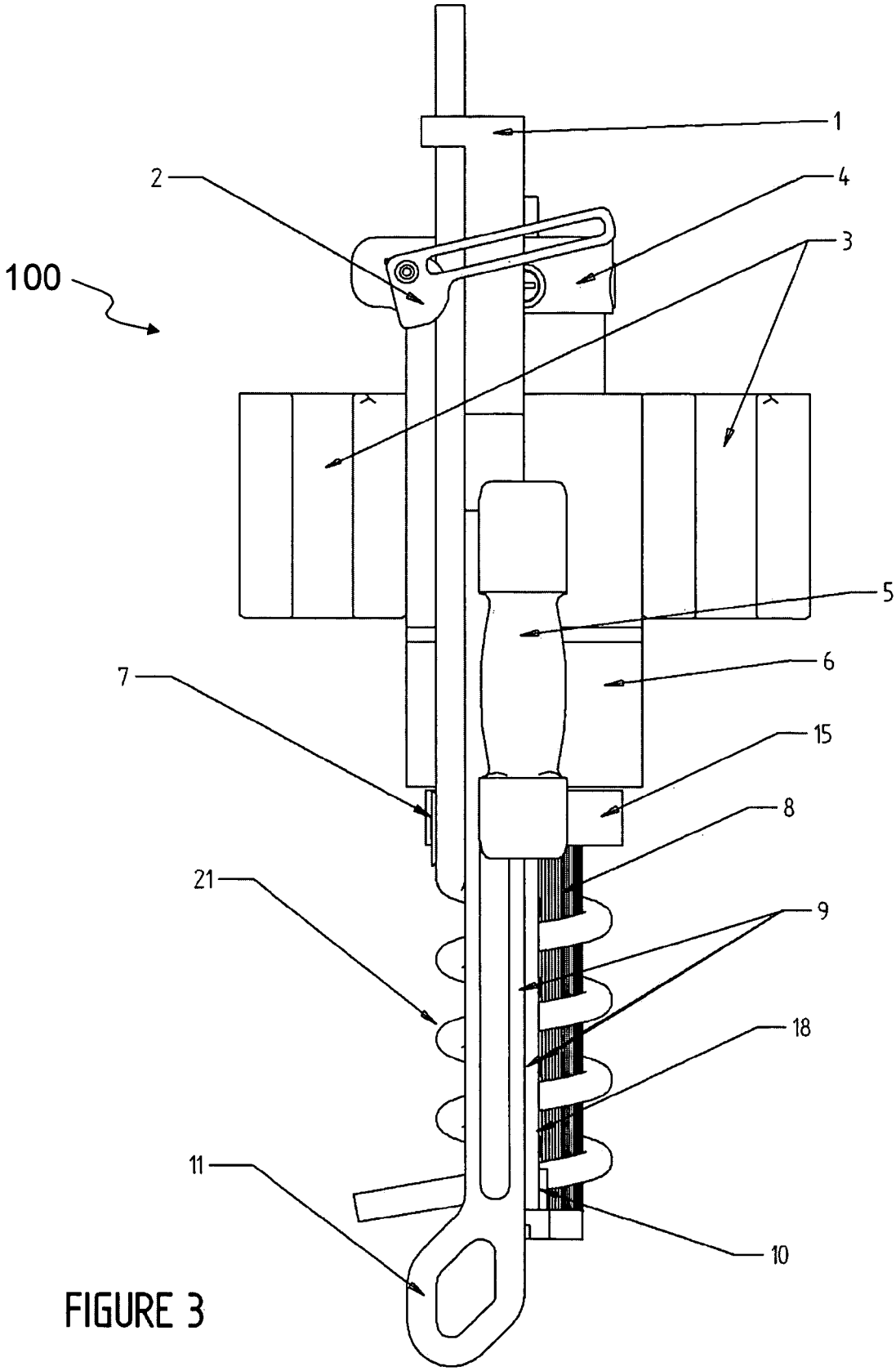
FIG. 3 shows a front view of the device of FIG. 2.
Figure 4:
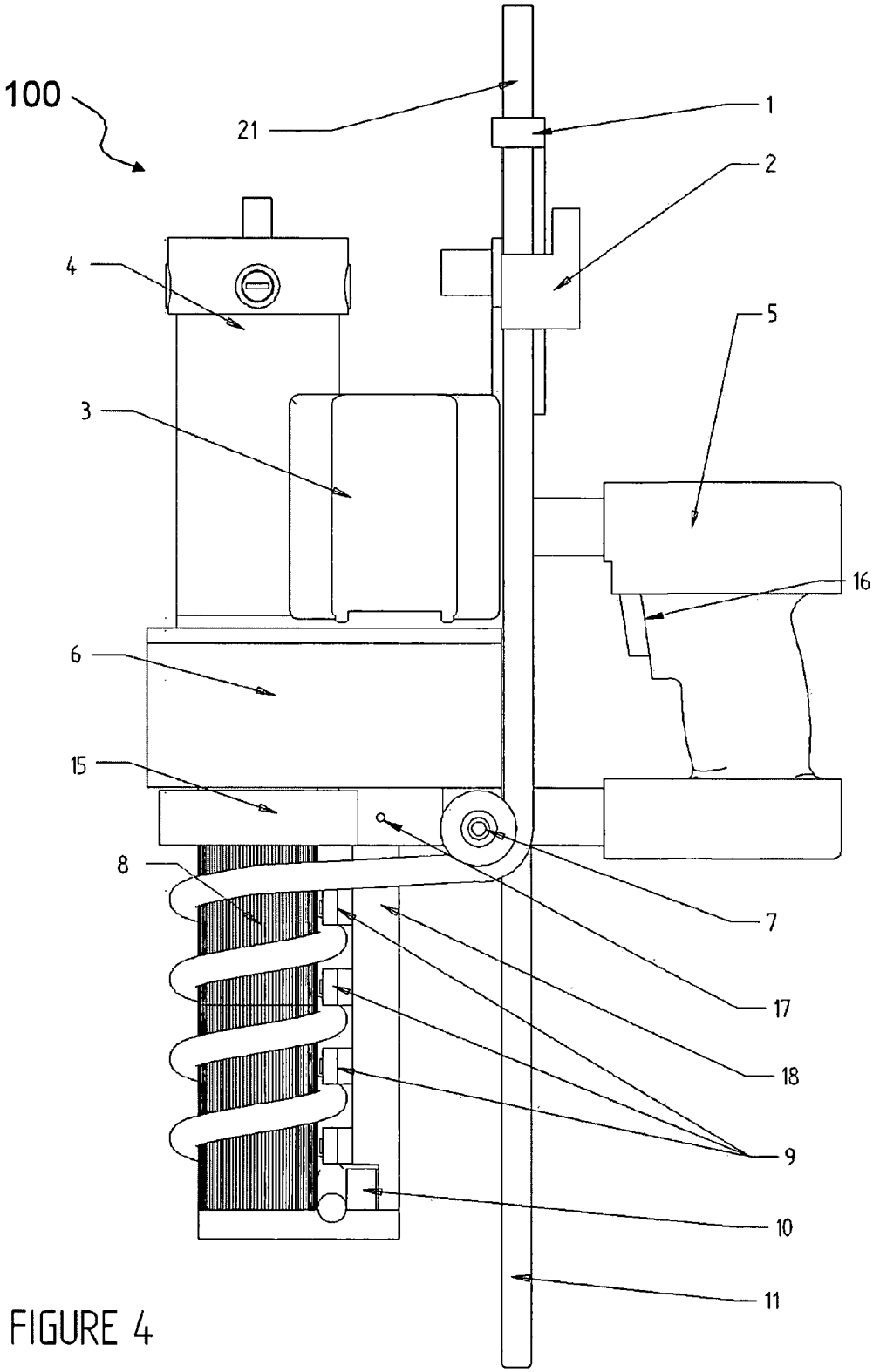
FIG. 4 shows a side view of the device of FIG. 2.
Figure 5:
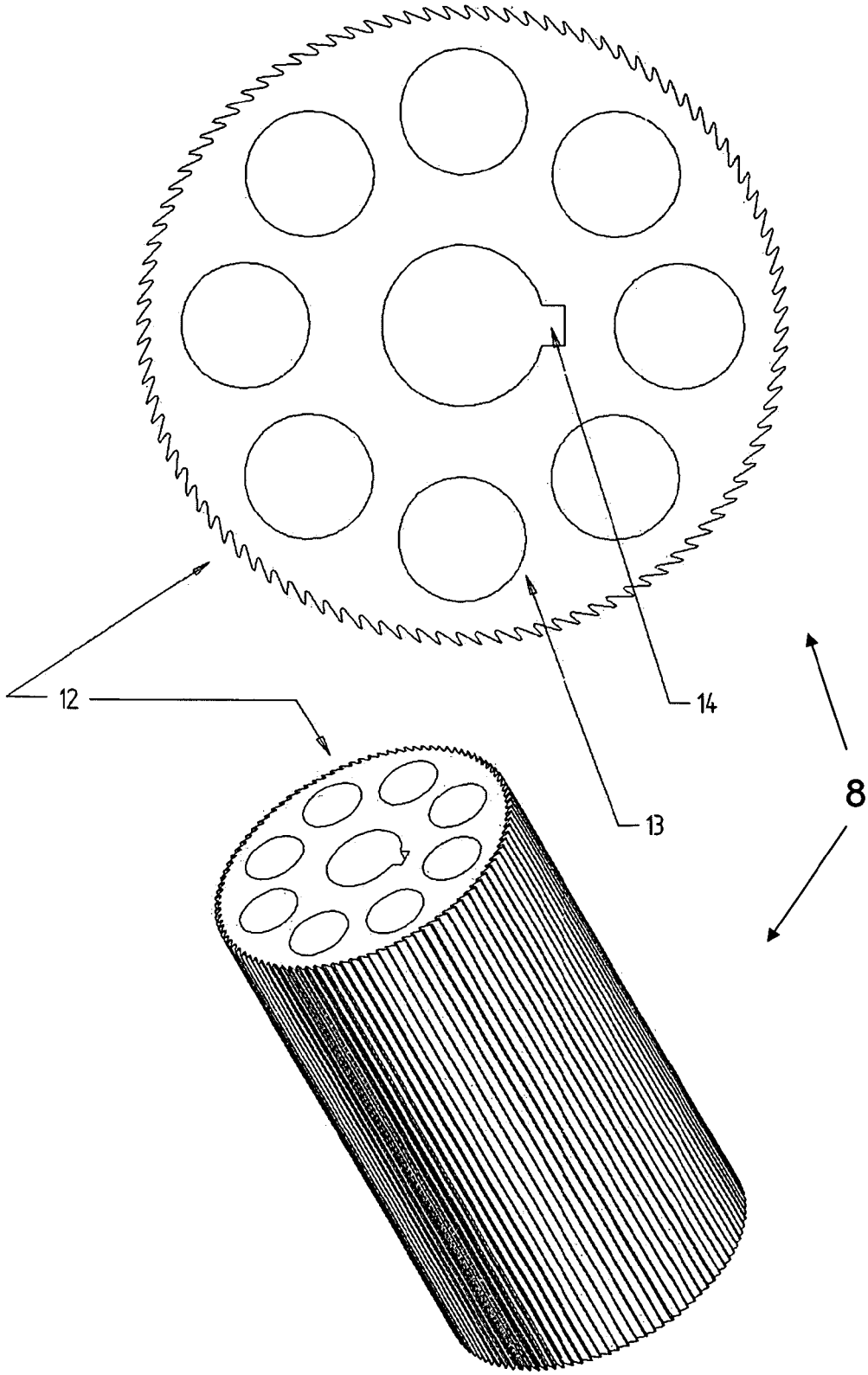
FIG. 5 shows a close-up profile and isometric view of the rotating drum of the device of FIG. 2.

As noted above, the operation of a rope pulling device of the invention can be aided by designing the surface of the rotating drum 8 to have anisotropic friction properties. In particular, the drum can be designed to have a high friction coefficient in a direction substantially about its circumference and a lower friction coefficient in a substantially longitudinal direction. In the embodiment illustrated in FIGS. 2 through 4, the surface of the drum is provided with longitudinal splines to create this anisotropic friction effect. A preferred embodiment of such a splined drum is shown in FIG. 5. In this embodiment, a cylinder, preferably constructed of aluminum or another lightweight metal or material, is extruded to include the illustrated longitudinal splines. More specifically, the rotating drum 8 embodiment of FIG. 5 can include longitudinal shaped-shaped splines 12 and a hole for a shaft with a keyway cutout 14. Forming the longitudinal splines as shaped features angled into the direction of motion of the rotating drum 8 further enhances the friction between the rope and the drum. A person skilled in the art will recognize that the drum of FIG. 5 is one preferred embodiment and that other features or methods of manufacture can be used to create the desired anisotropic friction effect.

Weight-reducing holes 13 can also be utilized to minimize weight of the entire device.

Returning now to FIGS. 2-4 to further describe the features and operation of this embodiment of a rope pulling device of the invention, rope 21 enters the device through the clip-in rope guide 1. As illustrated, a solid loop is provided, however, the rope guide 1 is preferably a carabiner-type clip into which the rope is pushed, rather than having to thread the rope through by its end. The rope then passes through the safety clamp 2, which allows rope to only move through the device in the tensioning direction.

In the case that rope is pulled backward through the device by any means, the safety clamp 2 grips the rope and pinches it against the adjacent surface. The handle on the safety clamp 2 allows a user to manually override that safety mechanism, by releasing the self-help imposed clamping force which the clamp applies to the rope against the body of the device. The safety clamp 2 is simply one as used in sailing and rock climbing, and uses directionally gripping surfaces along a continuously increasing radius to apply a stop-clamping force proportional to the rope tension which squeezes the rope against its guide.

After passing through the safety clamp, the rope is wrapped past the pulley 7 which guides the rope tangentially to the drum. The set of rollers 9 folds away from the drum, allowing the user to wrap the rope the designated number of times around the drum (in this case 5). After having wrapped the rope to the specified spacing, the rollers 9 fold back against the drum and are locked in place. The tensioning roller 15 squeezes the last turn of the rope against the splines in order to apply tension to the free end of the rope. Since the capstan effect occurs as:

$$T_1 = T_2 e^{(\mu\theta)} \quad [1]$$

Where $T_2$ is the tension off the free end (exiting tensioning roller 15), $T_1$, is the tension in the rope as it enters through the rope guide 1, $\mu$ is the frictional coefficient between the rope and the rotating drum 8, and $\theta$ is the amount the rope is wrapped around the rotating drum 8 in radians. An initial tension in the free end exiting roller 10 is necessary to achieve any kind of circumferential gripping of the rope around the capstan, i.e. $T_2$ cannot be 0. By squeezing the rope against the capstan splines 1 with the tensioning roller 10, $T_2$ tension is created by the last turn as it makes a no-slip condition which is reflected back through each turn to achieve a large tension at the first turn, $T_1$.

Since the rope guide 1 has a clip-in and the rollers 9 and tensioner 10 attached to roller support 18 fold away from the drum via pivot 17 (a person of skill in the art will note that the roller support is not limited to pivotal movement—any sliding motion, rotation, or combination thereof can suffice to move roller support 18 away), loading the rope into the device does not require stringing a free end through the device. The device can thus accommodate any length of rope and can join or detach from the rope at any point. This is a significant advantage over standard winch systems which must only use the length of rope or cable that is already attached, and which must be confined to one particular position and orientation for operation.

A person skilled in the art will also note that the rollers 9 can be held from within the rotating drum 8, positioned and held by stationary cylindrical segments fixtured to the gearbox 6 from solid supports located within rotating drum 8. Rotating drum 8 could thus be segmented with rollers 9 positioned in between segments of drum 8 at the same interval as in FIGS. 2-4. This circumvents the need for an external roller support 18, allowing for a elongate tensioning member to be wrapped around drum 8 and guided by rollers 9 roller support 18 in the way. An embodiment that utilizes this configuration is depicted in FIGS. 10 (isometric view), 11 (side view), and 12 (side view including rope illustration).

Longitudinal splines 12 on drum 8 improve the operation of the illustrated embodiment. These features create and use the anisotropic friction behavior along the drum which allows a wrap of a rope or cable to grip the drum circumferentially while moving readily along that drum axially. Exemplary splines 12 are jagged in the forward rotational direction in FIG. 5 where the illustrated drum is intended to apply force in a counterclockwise direction. The additional grip provided by the exemplary drum 8 maximizes the capstan effect in equation [1] created by a tensioned cable wrapped around a drum, significantly increasing the circumferential gripping, while still allowing axial motion of the wrap along the drum. This, combined with the axial force applied by rollers 9, overcomes a significant problem faced by others attempting to use a turning capstan (cylindrical drum) to advance a rope while maintaining a free end.

In a standard winch, rope is progressively built up on the rotating drum. If one were to attempt to maintain a free end of the rope and have the rope travel through the winch and exit continuously, a problem would arise. First, as shown by equation [1], without tension $T_2$ on the free end, no pulling force can be applied to the rope. Additionally, since the rope grips around the drum circumferentially while under tension, even if $T_2$ is artificially created, the rope will wrap back on itself because of spiraling of the wraps. Due to the uneven tension and uneven placement of that tension along the drum, an axial restoring force appears which pulls the taut first wrap ($T_1$) toward the loose wrap at tensioner 10. When the rope wraps back on itself, it binds, preventing any further pulling.

In the illustrated device, the rollers 9 positioned along the capstan provide a restoring force in the axial direction to keep the wraps from backing up and binding. The rotating guide 15 applies back-force to the first (and tightest) wrap where tension is $T_1$, (and therefore the most force is necessary to move that wrap down the drum). The splines 12 facilitate the use of the rollers 9 and rotational guide 15 by allowing circumferential gripping and torque application in the correct rotational direction, while allowing the tensioned wraps to be moved axially along the drum as they enter and exit the device. While this particular embodiment works well as illustrated, any sort of material or feature (such as other edge profiles, re-cycling sliders, pivots, and rollers) providing similar anisotropic friction conditions could be used as effectively.

An additional embodiment of the splined drum is one that changes diameter along its longitudinal axis in order to aid axial movement of wraps along its body. This could aid in the movement of the high-tension wraps as pushed by the rollers 9.

This illustrated embodiment of the rope pulling device enables new capabilities in pulling ropes and cables at high forces and speeds. The embodiment described utilizes a high-power DC electric motor 4, as built by Magmotor Corporation of Worcester, Mass. (part number S28-BP400X) which possesses an extremely high power-to weight ratio (over 8.6 HP developed in a motor weighing 7 lbs). The batteries 3 utilized are 24 V, 3AH Panasonic EY9210 B Ni-MH rechargeable batteries. The device incorporates a pulse-width modulating speed control, adjusted by squeezing the trigger 16, that proportionally changes the speed of the motor. This embodiment is designed to lift loads up to 250 lbs up a rope at a rate of 7 ft/sec. Simple reconfigurations of the applied voltage and gear ratio can customize the performance to lift at either higher rates and lower loads, or vice-versa.

Any embodiment of the design as described above can be used to apply continuous pulling force to flexible tensioning members (strings, ropes, cables, threads, fibers, filaments, etc.) of unlimited length. Also since the design allows for attachment to such a flexible tensioning member without the need of a free end, significant versatility is added. The design allows for a full range of flexible tensioning members to be utilized for a given rotating drum 8 diameter, further enhancing the usability of such a pulling device.

Figure 6:
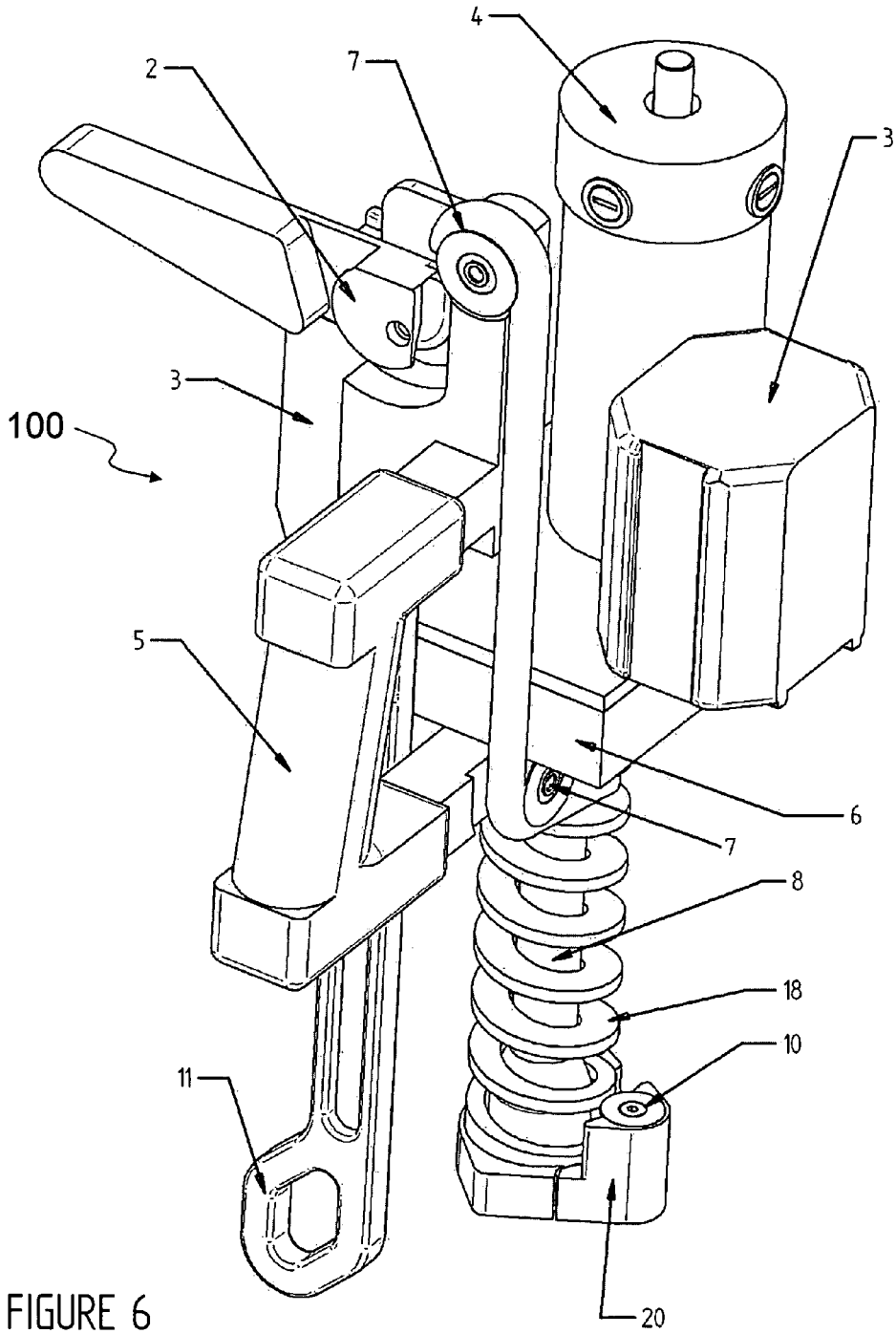
FIG. 6 shows an isometric view of an alternative embodiment of the invention.
Figure 7:
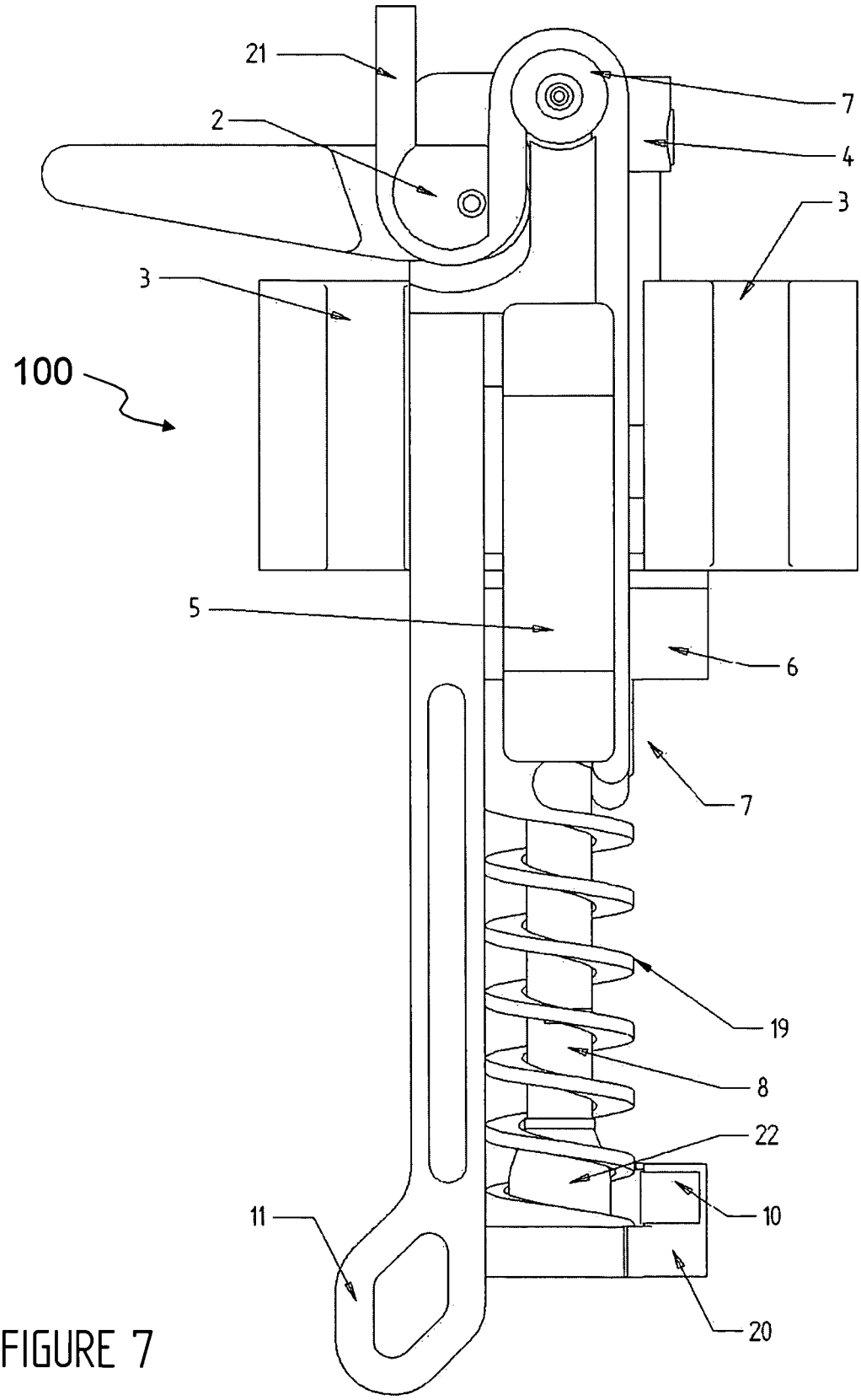
FIG. 7 shows a front view of the embodiment of FIG. 6.
Figure 8:
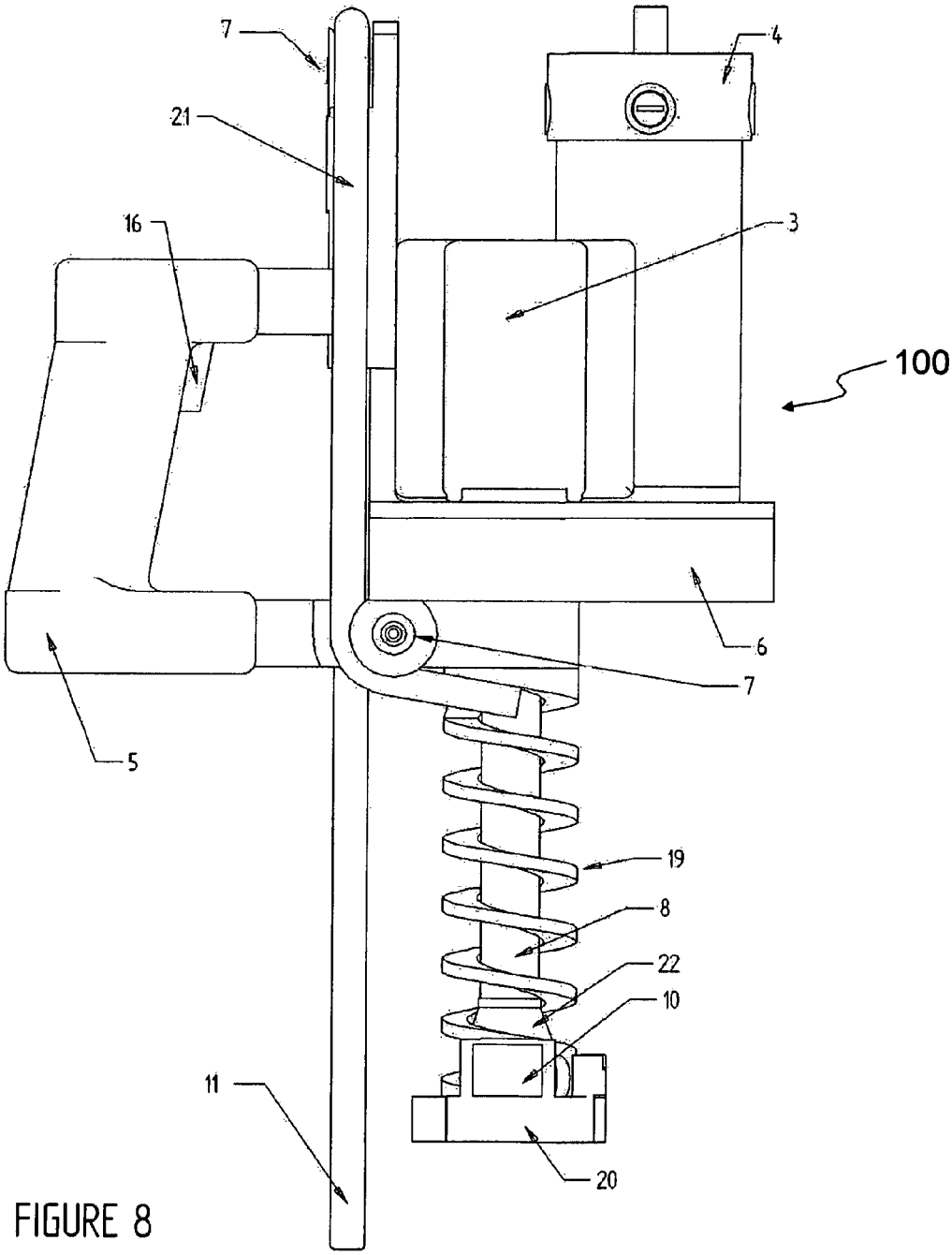
FIG. 8 shows a side view of the embodiment of FIG. 6.

A further embodiment of the invention is illustrated in FIGS. 6, 7 and 8. This embodiment operates on a number of the same simple principles as the embodiment of FIGS. 2 though 4, but relies on slightly different implementations of those principles. Rope enters the device by wrapping around the safety cam 2. This cam is a modified version of a Petzl Grigri rope belayer/descender, and uses a self-help pinching mechanism to prevent unwanted backward motion of a rope or cable. The handle allows the user to manually override that safety clamp in order to control a descent or back-driving of the rope through the device.

After the safety cam 2, the rope is wrapped around the pulleys 7 to be guided tangentially onto the rotating drum 8 within the spiral of the helix guide 19. The rope is wrapped through the turns of the helix guide 19, and the tensioning roller housing 20 is opened away from drum 8 to accept the rope as it goes through. Then the tensioning roller housing 20 is closed and clamped tight to the base of the helix guide S, which applies pressure from the tensioning roller 10 to the rope, clamping the rope against the tensioning drum 22.

Operation of this embodiment by a user is identical to that of the embodiment described above; the trigger 16 is squeezed, controlling the speed of the motor 4, which applies torque to the rotating drum 8 through the gearbox 6. The rope is gripped around the rotating drum 8 by the tension $T_1$ on the rope entering the device, as guided by the safety cam 2 and pulleys 7, and according to equation [1]. The tension $T_2$ which is necessary to make the device work is applied via the tensioning roller 10, as it is clamped by the tensioning roller housing 20. However, unlike the previous embodiments, instead of creating a no-slip condition to achieve $T_2$, a dynamic friction is utilized to tug on the rope, creating the needed tension in the free end.

This is accomplished by the tensioning drum 22 having a larger diameter than the rotating drum 8. Since both are attached to the same drive shaft out of the gearbox 6, they have the same rotational velocity. But because of the bigger diameter on the tensioning part of the drum 22, the surface velocity is greater. Because more turns (and the higher tension turns) in the rope are along the original diameter on the drum 8, rope is fed at the rotational velocity times the diameter of drum 8. Since the tensioning drum 22 has a greater diameter, it constantly slips against the surface of the rope. The normal force of the rope against drum 22 is increased by the tensioning roller, allowing for a greater pulling force to be created by drum 22. Thus, the dynamic friction against the last turn of the rope creates a constant $T_2$ which is the basis for the operation of the device, as per equation [1].

The problem of the rope wrapping back on itself is solved with the helix guide 19, which guides the rope onto and off of the rotating drum 8. Splines may not be used in this version, since it is more useful for smaller loads and the anisotropic friction is not a required feature. The helix guide 19 continually pushes the wraps axially down the drum 8, since the helix 19 is stationary and the rope must move. It provides the same function as the rollers 9 in the preferred embodiment, however with more friction. The helix 19 also still accommodates utilization of the rope or cable at any point, and the design for this embodiment does not require a free end of the rope to be strung through.

A user attaches to the device (or attaches an object to the device, or the device to ground) via the attachment point 11 as in the previous embodiment. The ergonomic handle 5 with speed-controlling trigger 16 provide easy use similar to that of a cordless drill. The batteries and motor can be the same as in the previous embodiment. This embodiment of the design, however, may be less expensive to manufacture and more useful in applications where continuous pulling of a flexible tensioning member is necessary under lower loads (e.g., less than 250 lbs).

An alternative embodiment depicted in FIGS. 9 (isometric view), 10 (side view) and 11 (side view including rope illustration). As previously noted with respect to FIGS. 2 through 4, the guide rollers 9 are mounted to a non-rotating section of the device in order to guide the wraps of the rope down the rotating drum 8. In that embodiment, the rollers 9 are mounted to the roller support 18. However, this embodiment requires the support 18 to be moved away from the rotating drum 8 in order to wrap the rope onto the capstan.

An alternative is to mount the guide rollers 9 to stationary mounts 25 placed between rotating drum sections 8 as depicted in FIGS. 10, 11 and 12. These stationary mounts are held stiff with respect to the device via the rotational constraints 24. The contour of the rotational constraints 24 allows for the rope to be wrapped around the capstan in a spiral fashion, with the wraps guided from one to the next by the guide rollers 9. The rollers 9 in this embodiment are held in place by the guide roller bolts 27. The axis of the bolts is oriented radially inward to the rotational axis of the rotating drum 8. A person skilled in the art will note that the orientation of the guide rollers 9 with respect to the circumference and rotational axis of the rotating drum sections 8 is not limited to that of this particular example other—roller orientations will still accomplish the task of moving the rope through each wrap.

The mounting of the entire capstan assembly embodiment is such that it replaces everything below the gearbox 6 in either of the two aforementioned embodiments. The capstan assembly base 23 mounts to the gearbox 6, with a drive shaft extending through both, all the way to the capstan end plate 28. The rotating drum sections 8 are locked to the drive shaft, and radial bearings are inside each stationary section 25, the capstan assembly base 23, and the capstan end plate 28.

The rope is guided onto the first rotating section 8 by the same guide pulley 7, and is then wrapped in a helical fashion around the assembly, going through each gap between the guide rollers 9. Finally, it is slipped between the tensioning roller 10 and the final stationary section 25, and the tensioner lever 26 is closed. The tensioning roller 10 is pressed against the rope, and is held in place by a latch that keeps the tensioner lever 26 tight against the capstan end plate 28.

After the tensioning roller 10 is closed and force is thus applied to the last wrap of the rope on the capstan, the devices is ready to be used. Using this embodiment, the rope can be fully engaged and disengaged from the device without threading an end through the mechanism.

A smaller version of this device could use the same sort of helical guide 19 and dynamic friction tensioner 10 to advance unlimited lengths of any sort of tensioning material, and could be particularly useful in the manufacture of cord materials such as steel cable, rope, thread, yarn, dental floss, and electrical conductors.

A person of ordinary skill in the art will recognize that the configurations described in FIGS. 1-11 are not the only configurations that can employ the principles of the invention. The system and method described above, utilizing circumferential gripping of a rotating drum while pulling with a free end of a tensioning member can be practically employed in other configurations. While certain features and aspects of the illustrated embodiments provide significant advantages in achieving one or more of the objects of the invention and/or solving one or more of the problems noted in conventional devices, any configuration or placement of all the parts, motor, battery, gearbox, and rotating drum/guide assembly with relation to one another could be deployed by a person of ordinary skill in keeping with the principles of the invention.

The lifting and pulling of heavy objects is a wide-ranging task inherent in many endeavors, commercial, domestic, military, and recreational. Current technology for portable lifting and pulling devices is limited to passive rope ascenders, as in climbers' equipment, and winches and come-alongs, which all have severe limitations for the power sources, rate of pulling, and types of tensioning members they can utilize.

The present invention, a portable rope pulling and climbing device, can solve many problems associated with using current lifting and pulling technology, including but not limited to: accommodating multiple types and diameters of flexible tensioning members, being able to attach to the flexible tensioning member without threading a free end through the device, providing a smooth continuous pull, providing a device which itself can travel up or along a rope, to provide a device which is easy and intuitive to use, to provide a device which can let out or descend a taut flexible tensioning member at a controlled rate with a range of loads, and to provide a device and method that is usable in and useful for recreation, industry, emergency, rescue, manufacturing, military, and other applications.

A person of ordinary skill in the art will appreciate further features and advantages of the invention based on the above-described embodiments. For example, specific features from any of the embodiments described above as well as in the Appendix below may be incorporated into devices or methods of the invention in a variety of combinations and subcombinations, as well as features referred to in the claims below which may be implemented by means described herein. Accordingly, the invention is not to be limited by what has been particularly shown and described, except as indicated by the appended claims or those ultimately provided. Any publications and references cited herein are expressly incorporated herein by reference in their entirety.

The invention claimed is:

1. A device for pulling a resilient elongate element, comprising:

a powered rotational motor having an output;

a rotating drum connected to the output of said rotational motor, the rotating drum having a longitudinal axis, an outer surface, and a circumference, wherein the outer surface includes a surface characterized by anisotropic friction;

a guide mechanism guiding the resilient elongate element onto, around at least a portion of the circumference of, and off of the rotating drum;

whereby when said powered rotational motor turns the rotating drum, the rotating drum thereby continuously pulls the resilient elongate element through the device.

2. The device of claim 1, further comprising a means for powering the rotational motor.

3. The device of claim 2, wherein the means for powering the rotational motor includes a plurality of rechargeable batteries.

4. The device of claim 1, wherein the powered rotational motor is a DC electric motor.

5. The device of claim 1, wherein the rotating drum is connected to the output of the rotational motor by a gearbox.

6. The device of claim 1, wherein the surface of the rotating drum has a higher coefficient of friction in at least one direction about its circumference than in a direction substantially along its longitudinal axis.

7. The device of claim 6, wherein the surface of the rotating drum has longitudinal splines.

8. The device of claim 7, wherein the splines have a saw tooth profile angled in a forward rotational direction.

9. The device of claim 1, wherein the guide mechanism is configured to cause the resilient elongate element to wrap around the rotating drum at least once.

10. The device of claim 9, wherein the guide mechanism is configured to cause the resilient elongate element to wrap around the rotating drum a plurality of times.

11. The device of claim 10, wherein the guide mechanism comprises a plurality of rollers oriented with rotational axes thereof orthogonal to rotational axis of said rotating drum with faces of the rollers being substantially flush to outer surface of said rotating drum.

12. The device of claim 10, wherein the guide mechanism includes a tensioner having a roller with an axis parallel to the longitudinal axis of the rotating drum and positioned so as to press against last wrap of said rope or cable on said rotating drum, thereby increasing the normal force between the resilient elongate element and the rotating drum.

13. The device of claim 9, wherein axis of said rotating drum is oriented parallel to axis of the resilient elongate element.

14. The device of claim 1, wherein the guide mechanism includes a safety cam with a handle to manually release a clamping force to prevent unwanted downward motion while maintaining capability for controlled downward motion.

15. The device of claim 1, wherein the guide mechanism includes one or more clip elements and is configured to attach to the resilient elongate element without threading an end of the resilient elongate element through the device.

16. The device of claim 1, further comprising a resilient elongate element engaged with the guide mechanism and the rotating drum.

17. The device of claim 16, further comprising an object having a weight attached to either the resilient element or the device for movement of the object by pulling on the resilient elongate element by the device.

18. The device of claim 17, wherein the object has a weight of 250 pounds and the object can be moved vertically by the device 50 feet in less than or equal to 8 seconds.

19. The device of claim 17, wherein the object is a person and the person is attached to the device.

20. The device of claim 1, wherein the device is configured to be a portable hand-held device.

21. The device of claim 1, wherein the device is configured to be a rope ascender.

22. A device for pulling a resilient elongate element, comprising:

a powered rotational motor having an output;

a rotating drum connected to the output of said rotational motor, the rotating drum having a longitudinal axis and a circumference;

a guide mechanism guiding the resilient elongate element onto, around at least a portion of the circumference of, and off of the rotating drum, the guide mechanism including a safety cam with a handle to manually release a clamping force to prevent unwanted downward motion while maintaining capability for controlled downward motion;

whereby when said powered rotational motor turns the rotating drum, the rotating drum thereby continuously pulls the resilient elongate element through the device.

23. The device of claim 22, further comprising a means for powering the rotational motor.

24. The device of claim 23, wherein the means for powering the rotational motor includes a plurality of rechargeable batteries.

25. The device of claim 22, wherein the powered rotational motor is a DC electric motor.

26. The device of claim 22, wherein the rotating drum is connected to the output of the rotational motor by a gearbox.

27. The device of claim 22, wherein an outer surface of the rotating drum has a higher coefficient of friction in at least one direction about its circumference than in a direction substantially along its longitudinal axis.

28. The device of claim 27, wherein the surface of the rotating drum has longitudinal splines.

29. The device of claim 28, wherein the splines have a saw tooth profile angled in a forward rotational direction.

30. The device of claim 22, wherein the guide mechanism is configured to cause the resilient elongate element to wrap around the rotating drum at least once.

31. The device of claim 30, wherein the guide mechanism is configured to cause the resilient elongate element to wrap around the rotating drum a plurality of times.

32. The device of claim 31, wherein the guide mechanism comprises a plurality of rollers oriented with rotational axes thereof orthogonal to rotational axis of said rotating drum with faces of the rollers being substantially flush to outer surface of said rotating drum.

33. The device of claim 31, wherein the guide mechanism includes a tensioner having a roller with an axis parallel to the longitudinal axis of the rotating drum and positioned so as to press against last wrap of said rope or cable on said rotating drum, thereby increasing the normal force between the resilient elongate element and the rotating drum.

34. The device of claim 30, wherein axis of said rotating drum is oriented parallel to axis of the resilient elongate element.

35. The device of claim 22, wherein the guide mechanism includes one or more clip elements and is configured to attach to the resilient elongate element without threading an end of the resilient elongate element through the device.

36. The device of claim 22, further comprising a resilient elongate element engaged with the guide mechanism and the rotating drum.

37. The device of claim 36, further comprising an object having a weight attached to either the resilient element or the device for movement of the object by pulling on the resilient elongate element by the device.

38. The device of claim 37, wherein the object has a weight of 250 pounds and the object can be moved vertically by the device 50 feet in less than or equal to 8 seconds.

39. The device of claim 37, wherein the object is a person and the person is attached to the device.

40. The device of claim 22, wherein the device is configured to be a portable hand-held device.

41. The device of claim 22, wherein the device is configured to be a rope ascender.

* * * * *